US005342049A

United States Patent [19]

Wichinsky et al.

[11] Patent Number: 5,342,049

[45] Date of Patent: Aug. 30, 1994

[54] GAMING MACHINE WITH SKILL FEATURE

[76] Inventors: Michael Wichinsky, 2575 S. Highland Dr., Las Vegas, Nev. 89109; Leroy H. Gutknecht, 5673 Annie Oakley, Las Vegas, N.Y. 89120; Claude A. Fernandez, 5028 S. Rainbow Blvd., #202, Las Vegas, Nev. 89118

[21] Appl. No.: 25,985

[22] Filed: Mar. 3, 1993

[51] Int. Cl.[5] ..... A63F 7/00

[52] U.S. Cl. ..... 273/119 R; 273/119 A; 273/121 A; 273/138 A; 273/143 A

[58] Field of Search ..... 273/118 R, 118 A, 119 R, 273/119 A, 121 R, 121 A, 123 R, 123 A, 138 R, 138 A, 143 R, 143 A, 129 R, 129 V, 127 R, 120 R, 120 A

[56] References Cited

U.S. PATENT DOCUMENTS

| | | | |
|---|---|---|---|
| 3,825,265 | 7/1974 | Pitkanen et al. . | |
| 4,030,555 | 6/1977 | Boyce et al. | 273/121 A X |
| 4,354,680 | 10/1982 | Kmiec | 273/121 A |
| 4,363,485 | 12/1982 | Edwall | 273/121 A |
| 4,437,664 | 3/1984 | Wiczer et al. | 273/129 V X |
| 4,487,414 | 12/1984 | Karkkainen et al. . | |
| 4,496,160 | 1/1985 | Wichinsky et al. . | |
| 5,014,991 | 5/1991 | Mirando et al. . | |
| 5,067,712 | 11/1991 | Georgilas . | |
| 5,090,699 | 2/1992 | Friedman . | |
| 5,104,129 | 4/1992 | Hamalainen et al. . | |
| 5,121,919 | 6/1992 | Martti . | |
| 5,131,655 | 7/1992 | Ugawa . | |

FOREIGN PATENT DOCUMENTS

| | | | |
|---|---|---|---|
| 2066991 | 7/1981 | United Kingdom | 273/121 A |
| 2124505 | 2/1984 | United Kingdom | 273/121 A |
| 2153572 | 8/1985 | United Kingdom . | |
| 2205188 | 11/1988 | United Kingdom . | |
| 8401908 | 5/1984 | World Int. Prop. O. | 273/121 A |

*Primary Examiner*—V. Millin
*Assistant Examiner*—Raleigh W. Chiu
*Attorney, Agent, or Firm*—John Edward Roethel

[57] ABSTRACT

A gaming machine combines a random selection feature with a skill feature to allow the player to utilize his ability to manipulate the skill feature to improve his chances of winning on the gaming machine. A reel slot machine is combined with a playing surface using a ball. The reel slot machine is first activated and a combination of slot symbols are randomly selected. The player manipulates a ball about a playing surface and the travel of the ball can result in additional spins of one or more reels of the slot machine so that other winning opportunities can be created. The gaming machine can be operated so that the playing surface is only activated when the player achieves a losing combination on the reel slot machine portion. This allows the player a second chance to win if he can use his skill on the playing surface to respin the reel slots. The player can also win "bonus" amounts as set out on a predetermined schedule of payouts by his skillful manipulation of the ball on the playing surface. Alternatively, the playing surface is activated after each spin of the reels to allow the player the opportunity to respin one or more of the reel slots after a losing spin or to improve a low pay winning spin. Finally, the gaming machine can be operated with a progressive jackpot feature using the results of the spin of the slot reels, the skillful manipulation of the playfield feature or both.

8 Claims, 6 Drawing Sheets

GAMING MACHINE WITH SKILL FEATURE

This invention relates to a gaming machine, and more particularly to a gaming machine that includes a feature that allows the player additional opportunities to win by engaging in a skill component of the game.

BACKGROUND OF THE INVENTION

Gaming machines typically allow a player a chance to win cash or merchandise for engaging in a game of chance. The player inserts money and pulls a handle, pushes a button or otherwise activates the gaming machine. The game of chance occurs and a winning or a losing play occurs.

In traditional reel slot machines, no player intervention occurs after the insertion of the money and the activation of the game. The reels spin, come to stop and the gaming machine displays the results of the reel spin. Whether the gaming machine is purely mechanical, electro-mechanical or purely electronic, the basic gaming function is the same: wins or losses are determined by random without any skill exercised by the player. Once the outcome has been determined, the player collects if he has won and the gaming machine is ready for another new play.

There have been modifications proposed to traditional reel slot machines. Reel slot machines have been designed that permit the player to "hold" one or more the reels from the first play and respin the unheld reels in an attempt to achieve a winning combination. Reel slot machines have been designed that permit the player to "step" one or more of the reels from the first play up or down a reel stop position to attempt to improve the combinations on the reels and create a winning play. These types of modifications allow the player an additional interaction with the outcome of the game, but such interaction is limited to a selection process by the player that is still dependent on the random operation of the gaming machine.

Video poker (in its various form of draw poker, wild card poker and stud poker) is another widespread gaming machine. The gaming device displays cards from a standard deck of playing cards and winning and losing combinations are determined according to standard poker hand ranking. In video poker, the player inserts money and pushes a button to activate the gaming machine. The selection of cards for the player's hand is determined at random by the electronics of the gaming machine. In the stud versions of video poker, the player has no input over the selection of the cards and the winning and losing combinations are purely random. In the draw versions of video poker, the player can select which cards to "hold" and then new cards are determined randomly by the electronics and displayed to the player.

Distinct from games of chance such as reel slot machines and video poker, there have been developed amusement games that rely on the skill of the player to effect the desired outcome and to create a winning play. Many years ago, pinball machines were developed in which a steel ball is propelled around a generally horizontal playing surface. As the ball hits targets, rolls over buttons, drops into holes and passes through slots, the player earns points that are accumulated as his score. The skill of the player in manipulating the flippers to propel the ball around the playing surface is the most significant factor in achieving a high score.

The development of microelectronics resulted in the creation of electronic video amusement games in which the mechanical elements of pinball were replaced by electronic displays. The player was required to manipulate an electronic blip around a playing surface to accumulate points. Again, the skill of the player was the main factor in how high the total of points would be.

The present invention is directed at combining the features of gaming devices that rely on the random determination of winning and losing plays with the skill-dependent features of amusement devices. The player's winning opportunities is dependent not only on a random event but also the skill of the player. Players who can successfully manipulate the skill feature of the gaming machine will achieve more winning opportunities than the players who are less skilled at that feature of the gaming machine.

It is an object of the present invention to provide a gaming machine that increases the player's opportunity to achieve a winning combination by utilizing the skill of the player as a component of the play of the gaming machine.

It is a feature of the present invention to combine in a single gaming machine both a random game feature (such as a reel slot machine) with a skill game feature (such as pinball-type game) that permits the player the opportunity to use his skill at manipulating a ball on a playing surface to reactivate the random game for another chance at achieving a winning combination.

It is an advantage of the present invention that the player will have an improved chance of winning by using his skill on the skill feature of the gaming machine to reactivate the random feature of the gaming machine. Thus the player can win not only from the original play of the random game feature but also from an additional play of the random game feature activated by his skillful manipulation of play on the playing field of the skill feature. Additionally, the player can also win "bonus" amounts, based on a posted schedule, from the play of the skill feature. Finally, the gaming machine of the present invention can be configured to utilize a progressive jackpot feature associated with the skill feature of the game.

Other objects, features and advantages of the present invention will become apparent from a consideration of the following detailed description.

SUMMARY OF THE INVENTION

A gaming machine combines both a random selection feature with a skill feature to allow the player to utilize his ability to manipulate the skill feature to improve his chances of winning on the gaming machine. In one version of the present invention, a reel slot machine is combined with a playing surface using a ball. The reel slot machine is first activated and a combination of slot symbols are randomly selected. The player then manipulates a ball about a playing surface and the travel of the ball can result in additional spins of one or more reels of the slot machine so that other winning opportunities can be created for the player.

The gaming machine of the present invention can be operated so that the playing surface is only activated when the player achieves a losing combination on the reel slot machine portion of the gaming machine. This allows the player a second chance to win if he can use his skill on the playing surface to respin the reel slots. The player can also win "bonus" amounts as set out on a predetermined schedule of payouts by his skillful manipulation of the ball on the playing surface.

Alternatively, the playing surface is activated after each spin of the reels to allow the player the opportunity to respin one or more of the reel slots after a losing spin or to improve a low pay winning spin.

Finally, the gaming machine of the present invention can be operated with a progressive jackpot feature based on the results of the spin of the slot reels, the skillful manipulation by the player of the playfield feature or both.

DETAILED DESCRIPTION OF THE PREFERRED EMBODIMENTS

Figure 1:
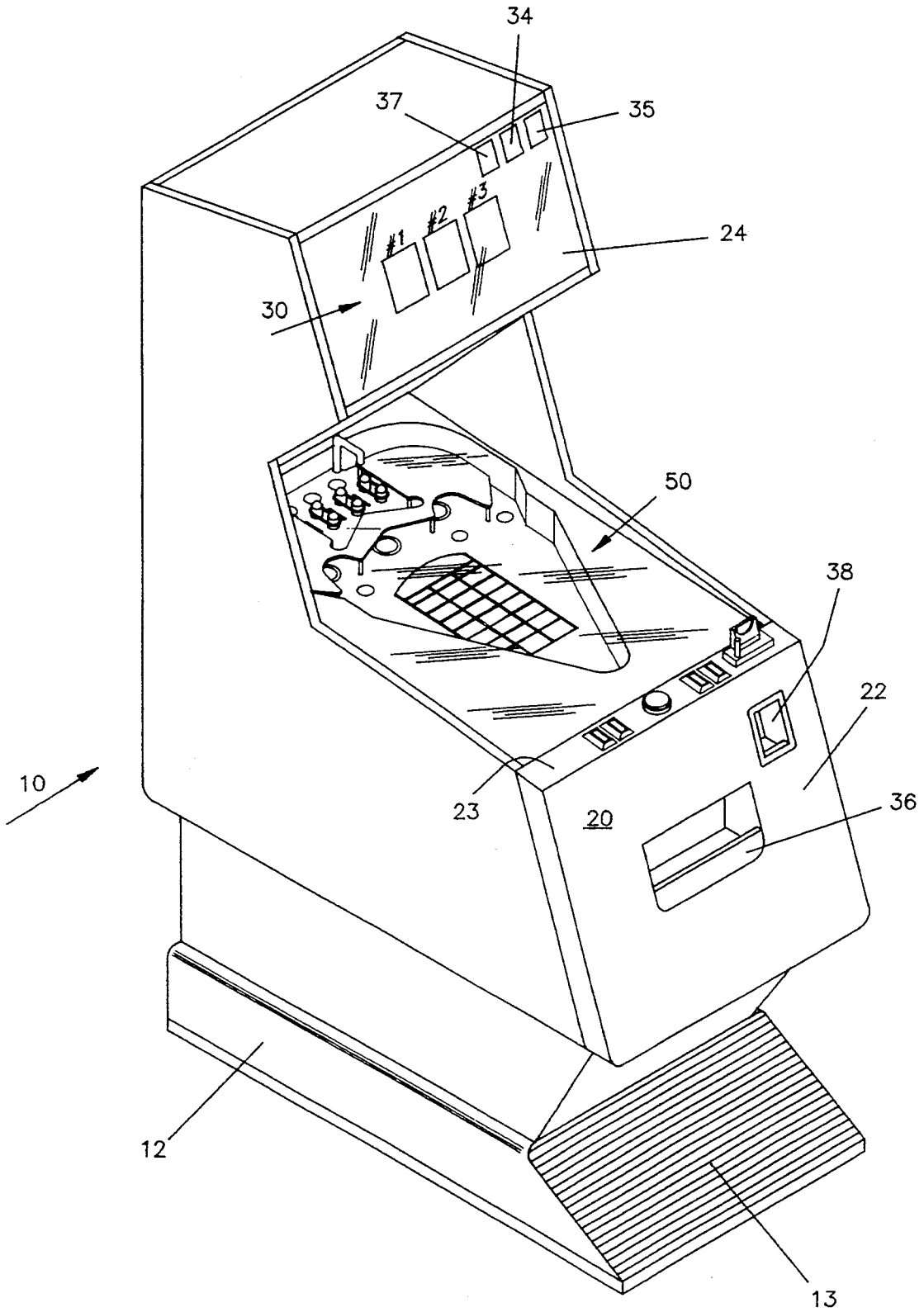
FIG. 1 shows an isometric view of a gaming machine of the present invention combining both a reel slot machine with a skill playing surface.
Figure 2:
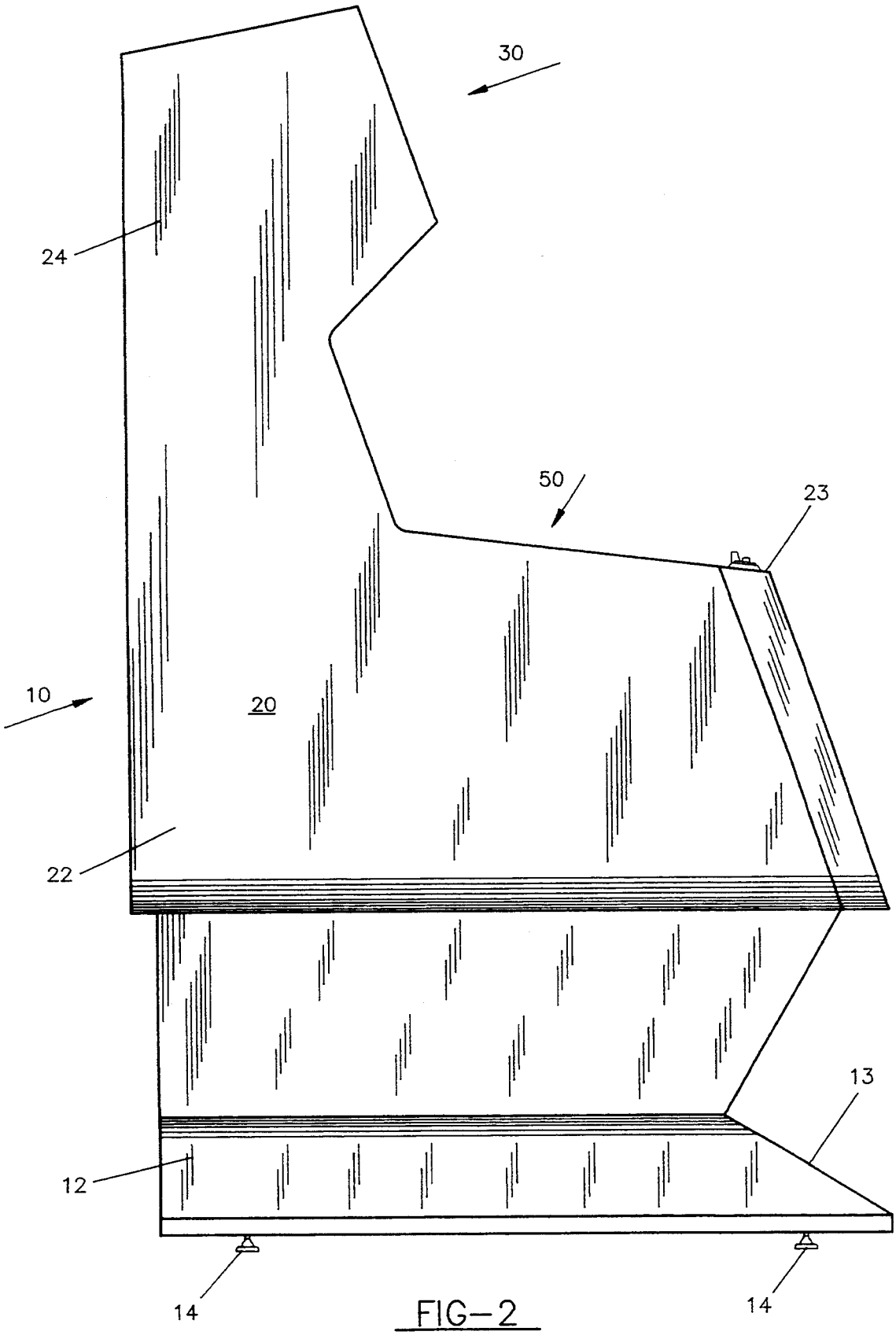
FIG. 2 shows a side view of the gaming machine of the present invention shown in FIG. 1.

The gaming machine of the present invention is shown generally at 10 in the drawings. The gaming machine 10 includes a cabinet 20 that sits on a base 12. A foot pad 13 is provided since the game is designed to be played by a standing player. A plurality of adjustable feet 14 are provided under the base 12 to level the gaming machine 10 so that the playing surface 50 will operate properly. The interior of the cabinet 20 includes the electronic circuitry and the mechanical components used to operate the gaming machine 10.

The cabinet 20 comprises a lower section 22 and an upper section 24. The lower section 22 houses the playfield apparatus for the playfield feature of the gaming machine 10. In addition to the electronic circuitry and the mechanical components for the playfield feature, a playing surface 50 is located at the upper level of the lower section 22 for viewing by the player. As is conventional in a pinball apparatus, the playing surface 50 is sloped slightly toward the front of the cabinet 20 so that the steel ball 55 will roll into a shooter 52 when not otherwise rolling around the playing surface 50. A steel ball 55 is the preferred ball to be used on the playing surface, although other types of balls such as plastic or wooden could also be used. The lower section 22 also includes a coin tray 36 and a coin return 38.

The upper section 24 houses the reel slot feature of the gaming machine 10. Displayed in the top of the upper section 24 are those portions of the slot reels 30 visible by the player. In this preferred embodiment of the present invention a three reel slot (designated #1, #2 and #3) is shown, although the invention is not to be limited to three reel slot machines, but rather can include any of the myriad of slot machine configurations that are well known to those of skill in the art. For example, any number of reels can be used and any number of symbols ("reel stops") around the perimeter of the reels can be used. The reels can be mechanical slot reels with the stopping positions of the reels controlled purely mechanically or controlled by electronics both of which are conventional and well known in the art. Alternatively, the reels can be video simulation of slot machine reels, light emitting diode simulation of slot machine reels or liquid crystal simulation of slot machine reels which are also well known in the art. Alternatively, instead of spinning circular reels, the symbols in the reel slot 30 can be displayed by the use of spinning "flip cards" or any other conventional rotary symbol display mechanism.

As an alternative to the use of a reel slot machine in the upper section of the gaming machine, a video poker display could be used. Five display positions can be provided, each of which would display a card from a deck of playing cards. The player would be awarded payouts or points based on the combination of the playing cards as compared to typical poker hand rankings, as is conventional in traditional video poker gaming machines.

Figure 3:
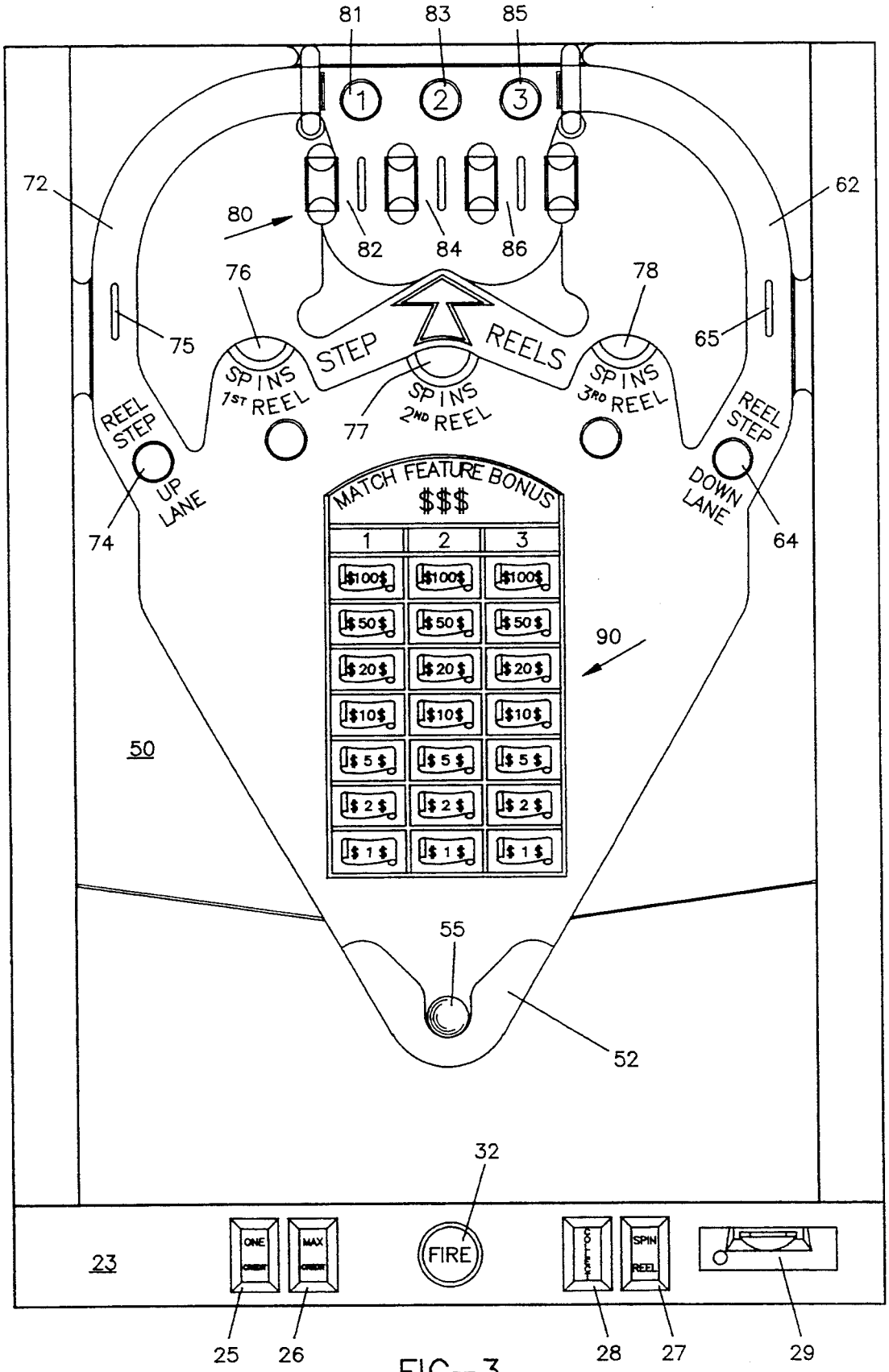
FIG. 3 shows a top view of the playing surface of the gaming machine of the present invention.

As shown in FIG. 3, adjacent to the playing surface 50 there is provided a control panel 23 at the upper end of the lower section 22. This control panel 23 houses the operating buttons to be used by the player during the operation of the gaming machine 10. The control panel 23 includes a one credit button 25 and a maximum credit button 26 to allow the player to wager a single coin or the maximum number of coins that the particular game permits. A spin reel button 27 activates the reel slot 30 after the wager is made.

The drawings depict the use of a mechanical coin entry 29 by which the player introduces coins or tokens into the gaming machine to activate the machine. The coin entry mechanism includes a conventional coin comparator as part of the apparatus to ensure that legal coins or legitimate tokens are being used. Any invalid coins or tokens are returned into the coin return 38. The invention is not limited to the use of a coin entry mechanism to activate the gaming mechanism; it is also within the scope of the invention to include a bill validator to allow the player to activate the gaming machine by using paper currency. Alternatively or additionally, the gaming machine can be operated in a "cashless" manner by the use of coupons, credit cards, debit cards or other electronic or mechanical devices which are well known in the art.

The collect button 28 allows the player to collect any winning amounts he has accrued during the play of the game. As in a typical gaming machine, winning amounts are accrued on a credit display 34 and the player collects his winnings by pressing the collect button 28. The winnings are issued to the player from a coin hopper located on the interior of the cabinet 20 and dispensed into a coin tray 36 located on the exterior of the gaming machine 10 in a manner conventional and well known in the art.

A firing button 32 is also located on the control panel 23 and is used in connection with the skill feature of the game as will be described herein.

The skill feature of the present invention uses the playing surface 50 shown in detail in FIG. 3. At the bottom of the playing surface 50 is a ball shooter 52 that is the home position for the steel ball 55. In the preferred embodiment of the present invention, the ball shooter 52 is a reciprocating component that rotates left and right under the operation of a motor (not shown). To shoot the steel ball 55 into the playing surface 50, the player pushes the firing button 32. Any conventional device can be used for the ball shooter 52, such as a spring-loaded plunger that pushes the steel ball 55 upon the activation by the player of the firing button 32.

On each lateral side of the playing surface 50, there is provided a right lane 62 with its associated right rollover light 64 and right rollover switch 65 and a left lane 72 with its associated left rollover light 74 and left rollover switch 75. In the proximate center of the playing surface 50 are provided a plurality of skill holes 76, 77 and 78, each with its own ball eject mechanisms as is conventional for a skill hole in a pinball machine.

At the top of the playing surface 50, an upper playfield section 80 is provided which includes a plurality of lights and lanes. The first reel light 81 corresponds to the first reel lane 82, the second reel light 83 corresponds to the second reel lane 84 and the third reel light 85 corresponds to the third reel lane 86. Adjacent to the ball shooter 52 and located on a portion of the playing surface 50 is a light feature display 90.

In operation, the player inserts one or more coins or tokens into the coin entry 29 or the player presses the single credit button 25 or the maximum credit button 26 to activate the gaming machine. The player then presses the spin reel button 27 to cause the slot machine feature of the gaming machine 10 to function. The results of the slot machine portion of the game are displayed on the pay line of the reel slot 30 as is conventional. If a winning combination is achieved, the player is paid the amount of the winning combination based on the number of coins or tokens that were bet. The payment can take the form of credits being accrued on the credit display 34 or direct payment to the player through a coin hopper into a coin tray 36. If credits are accrued, the player can use these credits for additional plays of the gaming machine or can cash out these credits by pressing the collect button 28 which activates the coin hopper to dispense coins or tokens into the coin tray 36.

Once the slot machine feature of the gaming machine 10 has been completed, the playfield feature is automatically activated. The ball shooter 52 begins to reciprocate back and forth and the firing button 32 becomes active to allow the player to shoot the steel ball 55 into the playing surface 50. The active state of the firing button 32 can be signalled by having it become illuminated. As the ball shooter 52 reciprocates, the player using his skill attempts to press the firing button 32 when the ball shooter 52 is aiming at that part of the playing surface 50 that the player wants the steel ball 55 to roll over.

When the firing button 32 is pressed, the ball shooter 52 shoots the steel ball 55 into the playing surface 50. The steel ball 55 rolls around the playing surface 50 as in a typical pinball game. The steel ball 55 can go up either one of the right lane 62 or the left lane 72 and into the upper playfield section 80 of the playing surface 50. Or the steel ball 55 can drop into one of the skill holes 76, 77 or 78. Or the steel ball 55 may simply roll around the playing surface 50 and roll back into the ball shooter 52.

The player skill is utilized in attempting to aim the ball shooter 52 so that the steel ball 55 will roll into that portion of the playing surface 50 to achieve a result beneficial to the player. The playfield skill feature of the gaming machine 10 can be configured in different ways so that various beneficial results can be achieved by the player.

In a preferred embodiment of the present invention, the player is attempting to affect the positions of the symbols on the reel slot 30. To assist the player in this regard, a light feature display 90 is provided in the playing surface 50. In one embodiment of the present invention, the symbols showing on the pay line of the reel slot 30 are also illuminated in the light feature display 90. Thus, if the reel slot 30 is showing a $100 symbol on reel #1, a $100 symbol on reel #2 and a $20 symbol on reel #3, the player will attempt to manipulate the steel ball 55 to change the symbol on reel #3 in hopes of achieving another $100 symbol on this reel.

Different elements or targets in or mounted on the playing surface 50 when activated by the steel ball 55 cause different reels to be respun. Any of the typical pinball-type targets can be used, such as skill holes, drop targets, roll-over buttons, ramps or standup targets.

For example, if the steel ball 55 comes to rest in skill hole 76, then the first reel is respun. If the steel ball 55 comes to rest in skill hole 77, then the second reel is respun. If the steel ball 55 comes to rest in skill hole 78, then the third reel is respun. After coming to rest in a skill hole and activating the respin of the appropriate slot reel, the ball ejector mechanism in the skill hole ejects the ball 55 back into the playing surface 50 as is conventional.

If the steel ball 55 rolls over the right rollover switch 65, one of the reels is stepped down one symbol. If the steel ball 55 rolls over the left rollover switch 75, one of the reels is stepped up one symbol. By rolling up either the right lane 62 or the left lane 72, the steel ball 55 goes into the upper playfield section 80. The steel ball 55 will eventually fall through one of the reel lanes in the upper section 80. If the steel ball 55 goes through the first reel lane 82, the first reel is respun as indicated by the first reel light 81. If the steel ball 55 goes through the second reel lane 84, the second reel is respun as indicated by the second reel light 83. If the steel ball 55 goes through the third reel lane 86, the third reel is respun as indicated by the third reel light 85.

If the player has skillfully manipulated the ball shooter 52 and the firing button 32, the steel ball 55 will activate one of these targets and one or more of the reels of the reel slot 30 will be respun. The outcome of this respin of the reel slot 30 may result in a winning combination and the player will receive a payout based on this winning combination of symbols on the reel slot 30.

Of course, it is possible that the steel ball 55 will merely roll around the playing surface 50 and not engage any of the components that would result in movement of the symbols on the reels or respinning of any of the wheels. In such a situation, the steel ball 55 will eventually roll back into the ball shooter 52 and the playfield portion of the game would be over.

In another preferred embodiment of the present invention, the light feature display 90 will not merely display the results of the first spin of the reel slot 30. Instead, the light feature display 90 will randomly display a combination of symbols that the player can attempt to achieve in order to win a "bonus" payment. For example, the light feature display 90 may illuminate to show a $100 symbol in column 1, a $50 symbol in column 2 and a $20 symbol in column 3. After the initial spin of the reel slot 30, the player will have the opportunity using the ball shooter 52 and the firing button 32 to manipulate the steel ball 55 about the playing surface 50 in an attempt to respin one or more of the reels to try and achieve the "bonus" winning combination illuminated on the light feature display 90. If the player can cause the reels on the reel slot 30 to match one or more of the "bonus" winning combination symbols, the player will win payouts based on a predetermined schedule.

Figure 4:
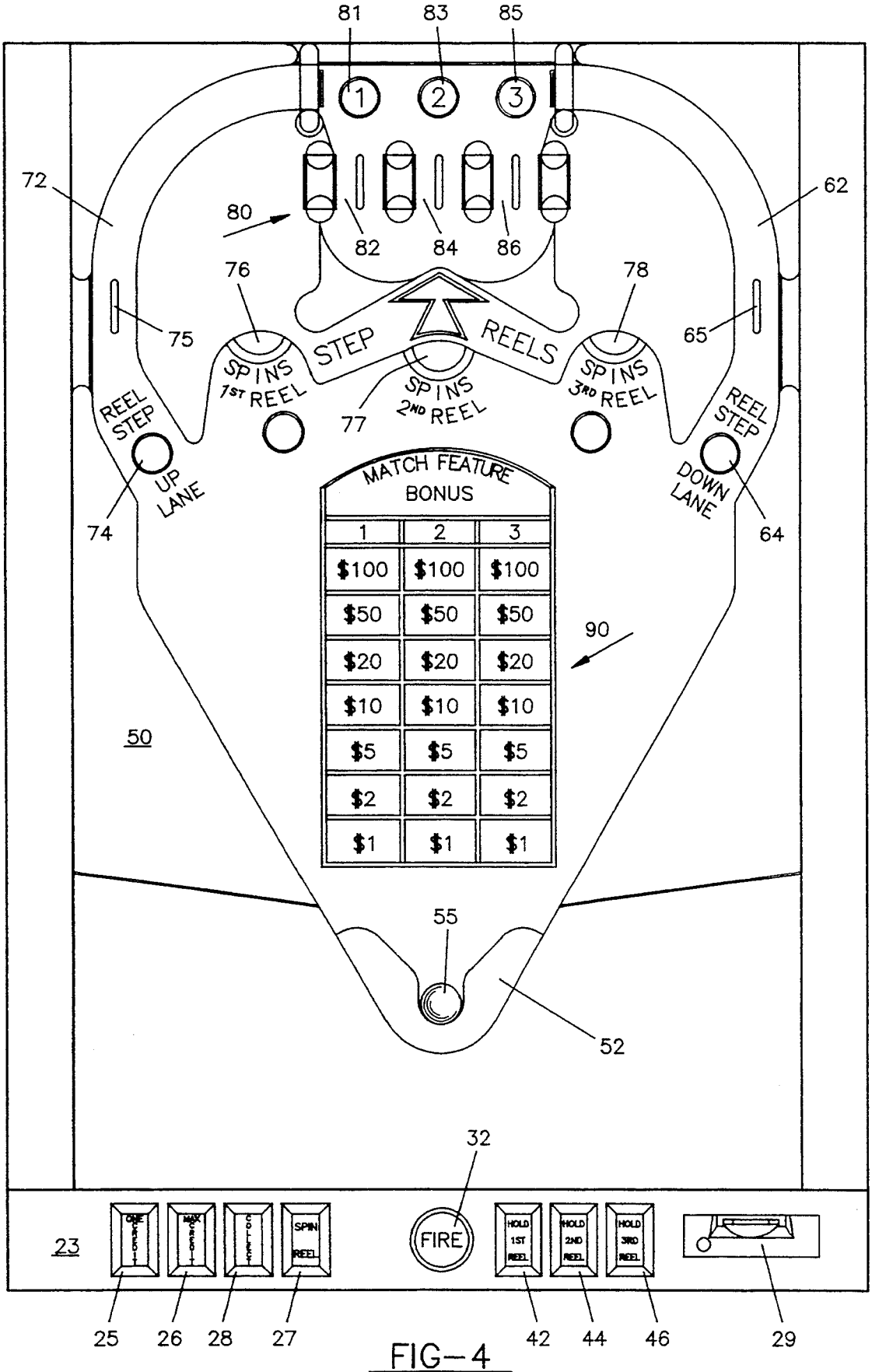
FIG. 4 shows a top view of the playing surface of the gaming machine of the present invention showing a modified control panel.

As an optional feature of the present invention as shown in FIG. 4, the gaming machine control panel 23 can be provided with "Hold" buttons that permit the player to hold one or more of the reels of the reel slot 30 during the play of the playfield feature. For example, after the spin of the reel slot 30, the player can push the first reel hold button 42 to keep the first reel from being respun during the play of the skill feature of the gaming machine. Similarly, the second reel hold button 44 and the third reel hold button 46 can be pressed by the player to hold each of these reels from being respun. If this feature is included in the gaming machine, the player will not have to worry that his play of the playfield feature will cause a winning reel to be respun and lessen his chance of winning.

In a preferred embodiment, the player would be given one opportunity with the steel ball 55 to use his skill to manipulate the reels on the reel slot 30. Alternatively, the game could be structured to give the player two or more chances with the steel ball 55 to change the outcome of the reel slot 30. The number of balls that the player has remaining is displayed on the ball display 35 in the upper section 24 of the gaming machine 10.

Another variation of the skill feature involves a "timing" feature in which the player is given a preselected amount of time to manipulate the steel ball 55 around the playing surface 50 to achieve as many different respins of the reels of the reel slot 30 as the player's skill will cause. The time remaining for the player is shown on the timer display 37 in the upper section 24 of the gaming machine 10. In order to encourage the player to increase his wagers, the number of balls or the amount of time allowed to the player can be dependent on the number of coins or tokens wagered at the start of the game.

In the alternative embodiment of the present invention in which video poker is displayed in the upper section of the gaming machine, the gaming machine can be configured so that the movement of the ball around the playing surface would result in one or more of the playing cards being replaced with new cards in an attempt for the player to improve his hand.

Figure 5:
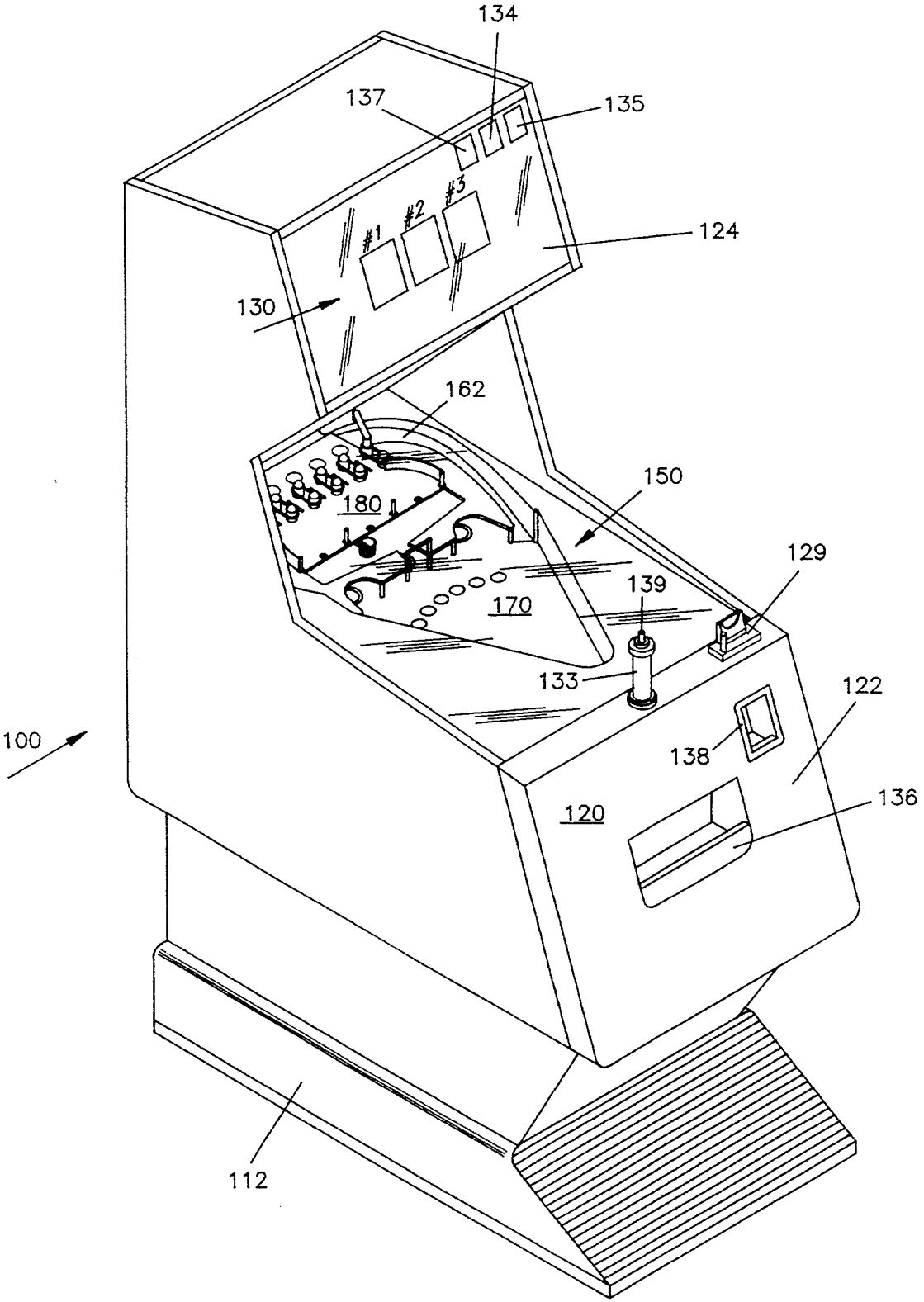
FIG. 5 shows an isometric view of a gaming machine of the present invention that utilizes the alternate playing surface shown in FIG. 6.
Figure 6:
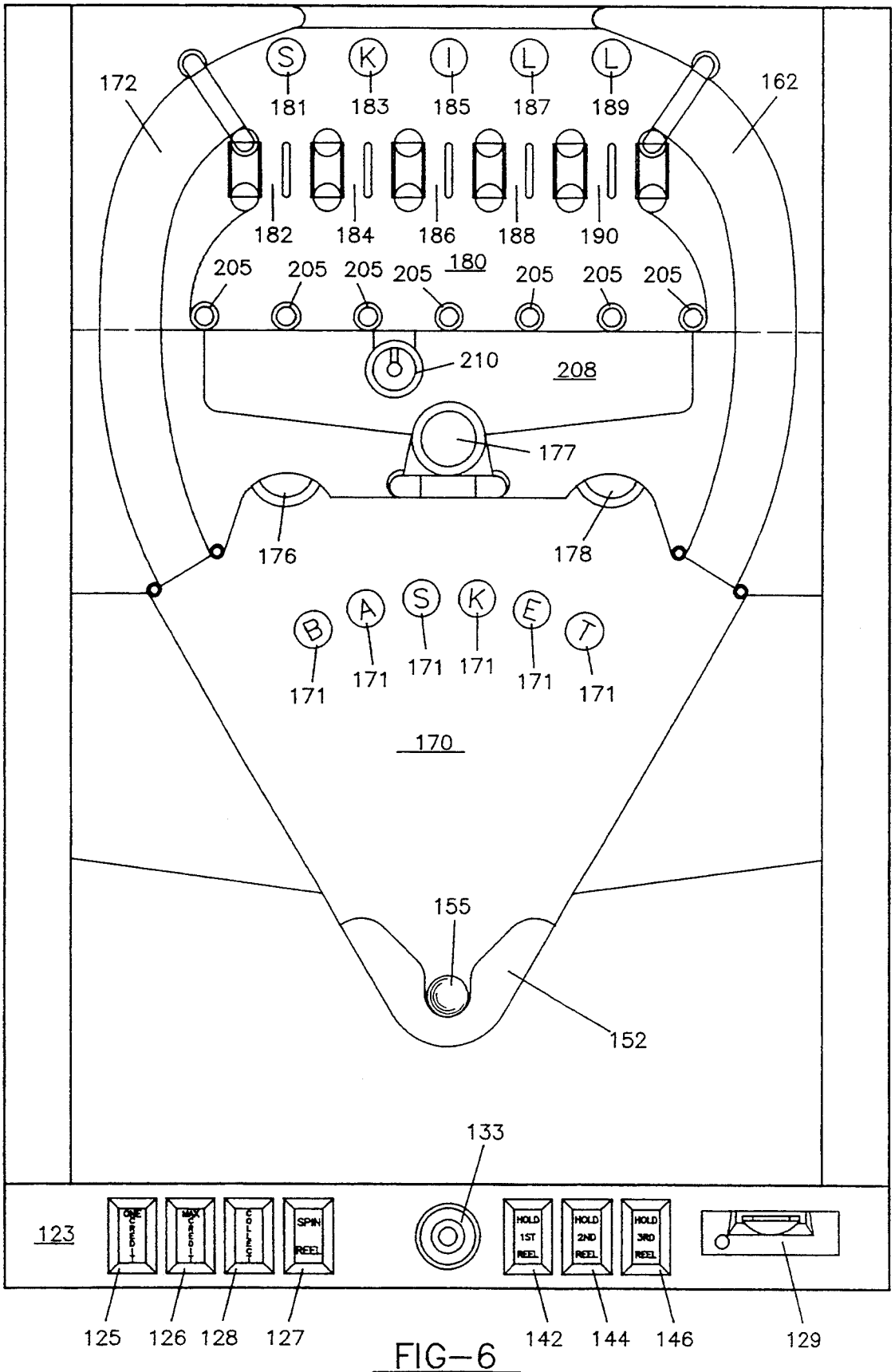
FIG. 6 shows a top view of an alternate version of the playing surface of the gaming machine of the present invention.

FIGS. 5 and 6 show an alternative playing field which utilizes a series of ramps and moving baskets so that the player must shoot the ball up one of the ramps and into a moving basket in order to cause one or more the reels of the reel slot 30 to be respun.

An alternate version gaming machine of the present invention is shown generally at 100 in FIG. 5. The gaming machine 100 includes a cabinet 120 that sits on a base 112. The interior of the cabinet 120 includes the electronic circuitry and the mechanical components used to operate the gaming machine 100.

The cabinet 120 comprises a lower section 122 and an upper section 124. The lower section 122 houses the playfield apparatus for the playfield feature of the gaming machine 100. A playing surface 150 is located at the upper level of the lower section 122 for viewing by the player. As is conventional in a pinball apparatus, the playing surface 150 is sloped slightly toward the front of the cabinet 120 so that the steel ball 155 will roll into a shooter 152 when not otherwise rolling around the playing surface 150. The lower section 122 also includes a coin tray 136 and a coin return 138.

The upper section 124 houses the reel slot feature of the gaming machine 100. Displayed in the top of the upper section 124 are those portions of the slot reels 130 visible by the player. As shown in FIG. 6, adjacent to the playing surface 150 there is provided a control panel 123 at the upper end of the lower section 122. This control panel 123 houses the operating buttons to be used by the player during the operation of the gaming machine 100. The control panel 123 includes a one credit button 125 and a maximum credit button 126 to allow the player to wager a single coin or the maximum number of coins that the particular game permits. A spin reel button 127 activates the reel slot 130 after the wager is made. The collect button 128 is also located on the panel 123. The control panel 123 also includes the mechanical coin entry 129 by which the player introduces coins or tokens into the gaming machine and the coin return 138.

A joystick 133 is also located on the control panel 23 and is used in connection with the skill feature of the game that uses the playing surface 150 shown in detail in FIG. 6. At the bottom of the playing surface 150 is a ball shooter 152 that is the home position for the steel ball 155. In this preferred embodiment of the present invention, the ball shooter 152 is a rotating component that rotates left and right under the operation of the joystick 133. To position the ball shooter 152 in the direction that the player wishes to shoot the ball 155, the player moves the joystick left or right which causes the shooter 152 to rotate left or right, respectively. To shoot the steel ball 155 into the playing surface 150, the player pushes the button on the joystick 133.

On each lateral side of the playing surface 150, there is provided a right lane 162 and a left lane 172. In this version of the present invention, each of the right lane 162 and the left lane 172 are ramps that run from the lower playfield section 170 to the upper playfield section 180. In the proximate center of the lower playfield section 170 of the playing surface 150 are provided a plurality of skill holes 176, 177 and 178, each with its own ball eject mechanisms as is conventional for a skill hole in a pinball machine. Also disposed across the lower playfield section 170 are a series of roll over lights 171, which, in this embodiment, spell out the word B-A-S-K-E-T.

At the top of the playing surface 150, an upper playfield section 180 is provided which includes a plurality of lights and lanes. In this embodiment, the first reel light 181 is an S and corresponds to the first reel lane 82, the second reel light 183 is a K, and corresponds to the second reel lane 184 and the third reel light 185 corresponds to the third reel lane 186, the fourth reel light 187 is an L, and corresponds to the fourth reel lane 188 and the fifth reel light 189 is an L, and corresponds to the fifth reel lane 190.

Just forward of the reel lanes are a series of bumpers 205 demarcating the end of the upper playfield section 180. A moving basket 210 is positioned in an opening 208 at the end of the upper playfield section 180 and moves back and forth across the end of the upper playfield section 180. Instead of a single moving basket 210, a plurality of moving or fixed baskets can be used.

In the operation of this embodiment of the present invention, the player inserts one or more coins or tokens into the coin entry 129 or the player presses the single credit button 125 or the maximum credit button 126 to activate the gaming machine. The player then presses the spin reel button 127 to cause the slot machine feature of the gaming machine 100 to function. The results of the slot machine portion of the game are displayed on the pay line of the reel slot 130 as is conventional. If a winning combination is achieved, the player is paid the amount of the winning combination based on the number of coins or tokens that were bet. The payment can take the form of credits being accrued on the credit display 134 or direct payment to the player through a coin hopper into a coin tray 136. If credits are accrued, the player can use these credits for additional plays of the gaming machine or can cash out these credits by pressing the collect button 128 which activates the coin hopper to dispense coins or tokens into the coin tray 136.

Once the slot machine feature of the gaming machine 100 has been completed, the playfield feature is automatically activated. The firing button 139 on the joystick 132 becomes active to allow the player to shoot the steel ball 155 into the playing surface 150. By manipulating the joystick 133, the player can aim the ball shooter 152 in the direction desired. The steel ball 155 rolls around the playing surface 150 as in a typical pinball game. The steel ball 155 can go up either one of the right lane 162 or the left lane 172 and into the upper playfield section 180 of the playing surface 150. Or the steel ball 155 can drop into one of the skill holes 176, 177 or 178. Or the steel ball 155 may simply roll around the playing surface 150 and roll back into the ball shooter 152.

As described in connection with the first embodiment of the invention, the player skill is utilized in attempting to aim the ball shooter 152 so that the steel ball 155 will roll into that portion of the playing surface 150 to achieve a result beneficial to the player. The playfield skill feature of the gaming machine 100 can be configured in different ways so that various beneficial results can be achieved by the player.

For example, if the steel ball 155 comes to rest in skill hole 176, then the first reel is respun. If the steel ball 155 comes to rest in skill hole 177, then the second reel is respun. If the steel ball 155 comes to rest in skill hole 178, then the third reel is respun. After coming to rest in a skill hole and activating the respin of the appropriate slot reel, the ball ejector mechanism in the skill hole ejects the ball 155 back into the playing surface 150 as is conventional.

If the steel ball 55 rolls up one of the left lane 162 or the right lane 172 into the upper playfield section 180, the steel ball 155 will eventually fall through one of the reel lanes in the upper section 180. If the steel ball 55 goes through the first reel lane 82, the first reel light 181 will be illuminated. Each reel lane has its respective reel light and the player attempts to illuminate as many of the reel lights as possible with credits being earned for the number of reel lights illuminated.

After the ball 155 falls through on the reel lanes, it will roll of the end of the upper playing section 180 and fall into the opening 208. If the ball 155 falls through a basket 210, the player will earn additional credits. After falling through opening 208, the ball passes into the lower playing section 170 where it may roll into one of the skill holes 176, 177 or 178 which will cause one of the reel slots to be respun. The ball 155 may also pass over one or more the roll over lights 171 earning the player even more credits.

Of course, it is possible that the steel ball 155 will merely roll around the playing surface 150 and not engage any of the components that would result in movement of the symbols on the reels or respinning of any of the wheels. In such a situation, the steel ball 155 will eventually roll back into the ball shooter 152 and the playfield portion of the game would be over.

As discussed in connection with first embodiment of the present invention, the control panel 123 can be provided with "Hold" buttons that permit the player to hold one or more of the reels of the reel slot 130 during the play of the playfield feature. For example, after the spin of the reel slot 130, the player can push the first reel hold button 142 to keep the first reel from being respun during the play of the skill feature of the gaming machine. Similarly, the second reel hold button 144 and the third reel hold button 146 can be pressed by the player to hold each of these reels from being respun.

This version of the game can be structured to give the player two or more chances with the steel ball 155 to change the outcome of the reel slot 130 or to score points by illuminating the reel lights or the roll over buttons. The number of balls that the player has remaining is displayed on the ball display 135 in the upper section 124 of the gaming machine 100. The "timing" feature in which the player is given a preselected amount of time to manipulate the steel ball 155 around the playing surface 150 can also be used. The time remaining for the player is shown on the timer display 137 in the upper section 124 of the gaming machine 100. In order to encourage the player to increase his wagers, the number of balls or the amount of time allowed to the player can be dependent on the number of coins or tokens wagered at the start of the game.

The other modifications discussed above relating to the first embodiment can also be utilized in this version of the present invention.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A gaming machine that includes both random features and skill features comprising:

a) a cabinet having a lower section and an upper section;

b) a playing surface located in the lower section and including a plurality of playfield targets;

c) a reciprocating ball shooter mounted in the lower section adjacent to the playing surface and a ball sized to fit in the ball shooter;

d) a reel slot machine located in the upper section including a plurality of reels, each reel having symbols located thereon;

e) means for receiving coins for initially activating the gaming machine;

f) means for activating the spinning of the reels and means for displaying at least one symbol on each of the reels on a pay line when the reels stop spinning;

g) means for paying the player when the symbols displayed on the pay line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved, the means for respinning at least one of the reels of the reel slot machine comprising a skill hole located on the playing surface, and j) means for paying the player for any amounts resulting from a winning combination on the pay line after one or more of the reels are respun.

2. A gaming machine that includes both random features and skill features comprising:

a) a cabinet having a lower section and an upper section;

b) a playing surface located in the lower section and including a plurality of playfield targets;

c) a reciprocating ball shooter mounted in the lower section adjacent to the playing surface and a ball sized to fit in the ball shooter;

d) a reel slot machine located in the upper section including a plurality of reels, each reel having symbols located thereon;

e) means for receiving coins for initially activating the gaming machine;

means for activating the spinning of the reels and means for displaying at least one symbol on each of the reels on a pay line when the reels stop spinning;

g) means for paying the player when the symbols displayed on the pay line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved, the means for respinning at least one of the reels of the reel slot machine comprises a reel lane located on a portion of the playing surface, and j) means for paying the player for any amounts resulting from a winning combination on the pay line after one or more of the reels are respun.

3. A gaming machine that includes both random features and skill features comprising:

a) a cabinet having a lower section and an upper section;

b) a playing surface located in the lower section and including a plurality of playfield targets;

c) a reciprocating ball shooter mounted in the lower section adjacent to the playing surface and a ball sized to fit in the ball shooter;

d) a reel slot machine located in the upper section including a plurality of reels, each reel having symbols located thereon;

e) means for receiving coins for initially activating the gaming machine;

f) means for activating the spinning of the reels and means for displaying at least one symbol on each of the reels on a pay line when the reels stop spinning;

g) means for paying the player when the symbols displayed on the pay line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved;

j) means for paying the player for any amounts resulting from a winning combination on the pay line after one or more of the reels are respun; and k) a light feature display including randomly illuminated symbols located on the playing surface and means for paying the player when the symbols on the pay line of the reel slot machine correspond to the illuminated symbols of the light feature display.

4. A gaming machine that includes both random features and skill features comprising:

a) a cabinet having a lower section and an upper section;

b) a playing surface located in the lower section and including a plurality of playfield targets, the playing surface having a lower playfield section and an upper playfield section and at least one lane connects the lower playfield section to the upper playfield section;

c) a reciprocating ball shooter mounted in the lower section adjacent to the playing surface and a ball sized to fit in the ball shooter;

d) a reel slot machine located in the upper section including a plurality of reels, each reel having symbols located thereon;

e) means for receiving coins for initially activating the gaming machine;

f) means for activating the spinning of the reels and means for displaying at least one symbol on each of the reels on a pay line when the reels stop spinning;

g) means for paying the player when the symbols displayed on the pay line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved, the means for respinning at least one of the reels of the reel slot machine comprising skill holes located on the lower playfield section, and j) means for paying the player for any amounts resulting from a winning combination on the pay line after one or more of the reels are respun.

5. An amusement machine that includes both random features and skill features comprising:

a) a cabinet having a lower section and an upper section;

b) a playing surface located in the lower section and including a plurality of playfield targets;

c) a reciprocating ball shooter located in the lower section adjacent to the playing surface and a ball sized to fit in the ball shooter;

d) a reel slot machine located in the upper section including a plurality of reels, each reel having symbols located thereon;

e) means for initially activating the amusement machine;

f) means for activating the spinning of the reels and means for displaying at least one symbol on each of the reels on a scoring line when the reels stop spinning;

g) means for allocating points to the player when the symbols displayed on the scoring line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved; the means for respinning at least one of the reels of the reel slot machine comprising a skill hole located on the playing surface; and j) means for allocating points to the player for any amounts resulting from a winning combination on the scoring line after one or more of the reels are respun.

6. An amusement machine that includes both random features and skill features comprising:

a) a cabinet having a lower section and an upper section;

b) a playing surface located in the lower section and including a plurality of playfield targets;

c) a reciprocating ball shooter located in the lower section adjacent to the playing surface and a ball sized to fit in the ball shooter;

d) a reel slot machine located in the upper section including a plurality of reels, each reel having symbols located thereon;

e) means for initially activating the amusement machine;

f) means for activating the spinning of the reels and means for displaying at least one symbol on each of the reels on a scoring line when the reels stop spinning;

g) means for allocating points to the player when the symbols displayed on the scoring line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved; the means for respinning at least one of the reels of the reel slot machine comprising a reel lane located on a portion of the playing surface; and j) means for allocating points to the player for any amounts resulting from a winning combination on the scoring line after one or more of the reels are respun.

7. An amusement machine that includes both random features and skill features comprising:

a) a cabinet having a lower section and an upper section;

b) a playing surface located in the lower section and including a plurality of playfield targets;

c) a reciprocating ball shooter located in the lower section adjacent to the playing surface and a ball sized to fit in the ball shooter;

d) a reel slot machine located in the upper section including a plurality of reels, each reel having symbols located thereon;

e) means for initially activating the amusement machine;

f) means for activating the spinning of the reels and means for displaying at least one symbol on each of the reels on a scoring line when the reels stop spinning;

g) means for allocating points to the player when the symbols displayed on the scoring line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved;

j) means for allocating points to the player for any amounts resulting from a winning combination on the scoring line after one or more of the reels are respun; and k) a light feature display including randomly illuminated symbols located on the playing surface and means for allocating points to the player when the symbols on the pay line of the reel slot machine correspond to the illuminated symbols of the light feature display.

8. An amusement machine that includes both random features and skill features comprising:

a) a cabinet having a lower section and an upper section;

b) a playing surface located in the lower section and including a plurality of playfield targets, the playing surface having a lower playfield section and an upper playfield section and at least one lane connects the lower playfield section to the upper playfield section;

c) a reciprocating ball shooter located in the lower section adjacent to the playing surface and a ball sized to fit in the ball shooter;

d) a reel slot machine located in the upper section including a plurality of reels, each reel having symbols located thereon;

e) means for initially activating the amusement machine;

f) means for activating the spinning of the reels and means for displaying at least one symbol on each of the reels on a scoring line when the reels stop spinning;

g) means for allocating points to the player when the symbols displayed on the scoring line comprise a winning combination;

h) means for activating the ball shooter to shoot the ball across the playing surface;

i) means for respinning at least one of the reels of the reel slot machine when the ball activates one of the playfield targets so that a new random selection of a symbol on the reel is achieved, the means for respinning at least one of the reels of the reel slot machine comprising skill holes located on the lower playfield section; and j) means for allocating points to the player for any amounts resulting from a winning combination on the scoring line after one or more of the reels are respun.

* * * * *